US010617230B2

(12) United States Patent
Coetzee

(10) Patent No.: US 10,617,230 B2
(45) Date of Patent: Apr. 14, 2020

(54) PRODUCT DISPLAY APPARATUS

(71) Applicant: Marcel Coetzee, Western Cape (ZA)

(72) Inventor: Marcel Coetzee, Western Cape (ZA)

( * ) Notice: Subject to any disclaimer, the term of this patent is extended or adjusted under 35 U.S.C. 154(b) by 0 days.

(21) Appl. No.: 16/347,692

(22) PCT Filed: Oct. 13, 2017

(86) PCT No.: PCT/ZA2017/050078
§ 371 (c)(1),
(2) Date: May 6, 2019

(87) PCT Pub. No.: WO2018/102836
PCT Pub. Date: Jun. 7, 2018

(65) Prior Publication Data

US 2019/0328156 A1 Oct. 31, 2019

(30) Foreign Application Priority Data

Nov. 30, 2016 (ZA) ..... 2016/08287

(51) Int. Cl.
*A47F 3/08* (2006.01)
*A47F 3/00* (2006.01)
*A47F 5/00* (2006.01)
*G09F 19/02* (2006.01)

(52) U.S. Cl.
CPC ..... *A47F 3/08* (2013.01); *A47F 3/001* (2013.01); *A47F 5/005* (2013.01); *A47F 5/0093* (2013.01); *G09F 19/02* (2013.01)

(58) Field of Classification Search
CPC ..... A47F 3/08; A47F 3/001; A47F 5/0043; A47F 5/0081; A47F 5/0093; G09F 19/02
See application file for complete search history.

(56) References Cited

U.S. PATENT DOCUMENTS 5,703,564 A 12/1997 Begum et al.
2008/0215443 A1* 9/2008 Dooley ..... G06Q 30/02 705/14.38

(Continued)

FOREIGN PATENT DOCUMENTS

EP 1348359 A1 10/2003
WO 2013044365 A1 4/2013

OTHER PUBLICATIONS

International Search Report dated Dec. 20, 2017 from corresponding PCT Application No. PCT/ZA2017/050078.

*Primary Examiner* — Daniel J Rohrhoff
(74) *Attorney, Agent, or Firm* — Innovation Capital Law Group, LLP; Vic Lin

(57) ABSTRACT

A product display apparatus includes: (i) a shelving unit (12) defining a plurality of vertically arranged shelves (14); (ii) a base (18) mounted to one of the shelves (14); (Hi) an elongate arm (20) slidably connected to the base (18); (iv) an actuator (24) for extending and retracting the arm (20); (v) at least one first sensor (32) that senses the presence of an object at: (a) a first predetermined distance; and (b) a second predetermined distance; (vi) a control module (36) that causes the actuator (24) to extend and retract the arm (20) in response to feedback from the at least one first sensor (32); (vii) a connecting means (26) at or near a first axial end (20*a*) of the arm (20); and (viii) a product (16) secured to the first axial end (20*a*) of the arm (20) via the connecting means.

15 Claims, 4 Drawing Sheets

(56) References Cited

U.S. PATENT DOCUMENTS

| | | | | |
|---|---|---|---|---|
| 2015/0092397 | A1* | 4/2015 | Liu | A47F 11/10<br>362/127 |
| 2018/0035825 | A1* | 2/2018 | Pollpeter | A47B 57/58 |
| 2019/0261789 | A1* | 8/2019 | Millman | A47G 1/06 |
| 2019/0313813 | A1* | 10/2019 | Honermann | A47F 7/0028 |

* cited by examiner

PRODUCT DISPLAY APPARATUS

BACKGROUND

The present invention relates to a product display apparatus. More particularly, the present invention relates to a shelving unit with an actuated arm for extending/retracting a product from/to a shelf in response to the proximity of shoppers.

Retail product promotions aim to attract attention to a featured retail product on the shelf. For this reason, many promoted products are positioned at the aisle ends. However, the shelving space at aisle ends is limited and attracting attention to products located along the aisled is less effective. To highlight products along the aisles, retailers attach boards with lights or flashing messages to the aisle shelves. However: where these boards are aligned with the shelf front, the boards are only visible to shoppers in the vicinity of the board; and where these boards extend perpendicular to the shelf front, protruding into the aisle (i.e. being visible to shoppers walking and looking along the aisle), the boards pose an obstacle to the flow of shoppers along the aisle and are prone to damaged from contact with shoppers. Furthermore, the obstruction caused by protruding signs limits the length of the sign (i.e. the distance that the sign protrudes into the aisle).

It is an object of the present invention to provide a product display apparatus that attracts the attention of shoppers traveling and looking along the aisles, but which addresses the drawback of prior art devices.

SUMMARY OF THE INVENTION

According to a preferred embodiment of the invention, there is provided a product display apparatus that includes:

- a shelving unit defining a plurality of vertically arranged shelves;
- a base mounted to one of the shelves;
- an elongate arm slidably connected to the base;
- an actuator for extending and retracting the arm;
- at least one first sensor that senses the presence of an object at: (i) a first predetermined distance; and (ii) a second predetermined distance;
- a control module that causes the actuator to extend and retract the arm in response to feedback from the at least one first sensor;
- a connecting means at or near a first axial end of the arm; and
- a product secured to the first axial end of the arm via the connecting means.

Preferably, the first sensor is an ultrasonic sensor.

Typically, the control module induces: (i) a first motion in the arm via the actuator when the at least one ultrasonic sensor senses the presence of an object at a first predetermined distance; and (ii) a second motion of the arm via the actuator when the at least one ultrasonic sensor senses the presence of an object at a second predetermined distance.

Generally, the product is: a pamphlet or brochure relating to adjacent products supported on the shelf on which the base is mounted; a holder for such pamphlets/brochures; or a retail product similar to adjacent products supported on the shelf on which the base is mounted.

Preferably, the base is mounted to the shelf by a clamp or with adhesive.

Typically, the arm is movable between: (i) an extended condition, in which the arm extends between 200 mm and 600 mm past the operative front edge of the shelf; and (ii) a retracted condition, in which the arm does not protrude more than 100 mm past the operative front edge of the shelf.

Generally, the product display apparatus further includes a platform at or near the operative bottom of the first axial end of the arm, which platform is located operatively below the product secured to the first axial end of the arm.

Preferably, a first light is associated with the platform to illuminate the platform and/or the product secured to the first axial end of the arm.

Typically, the product display apparatus further includes means for securing an advertising board to each side of the arm and to the first axial end of the arm.

Generally, the product display apparatus further includes at least one infrared sensor, and wherein the control module causes the actuator to extend and retract the arm in response to feedback from the at least one ultrasonic sensor and the at least one infrared sensor.

Preferably, the at least one infrared sensor is located at the first axial end of the arm.

Typically, the product display apparatus further includes an electrical conductor that extends axially within the arm.

Preferably, the product display apparatus further includes a second light on the arm.

Typically, the at least one ultrasonic sensor is located on the base.

Generally, the product display apparatus further includes a shield between the at least one ultrasonic sensor and the arm, which shield blocks movement of the arm from the ultrasonic sensor.

BRIEF DESCRIPTION OF THE DRAWINGS

The invention will now be described in more detail, by way of example only, with reference to the accompanying drawings in which.

DESCRIPTION OF THE INVENTION

Figure 1:
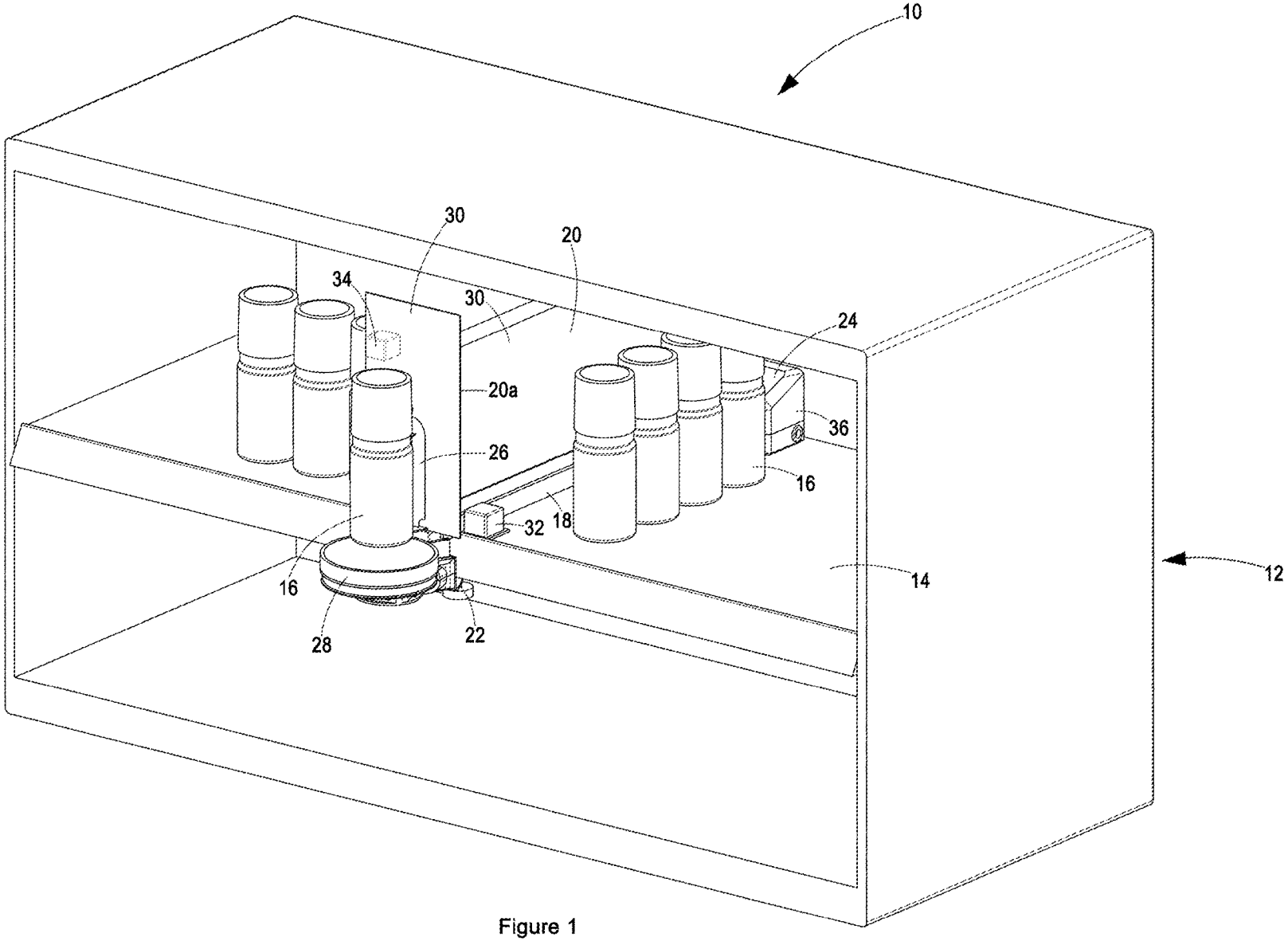
FIG. 1 is an upper perspective view of a product display apparatus according to a preferred embodiment of the invention, with the arm in a retracted condition.
Figure 2:
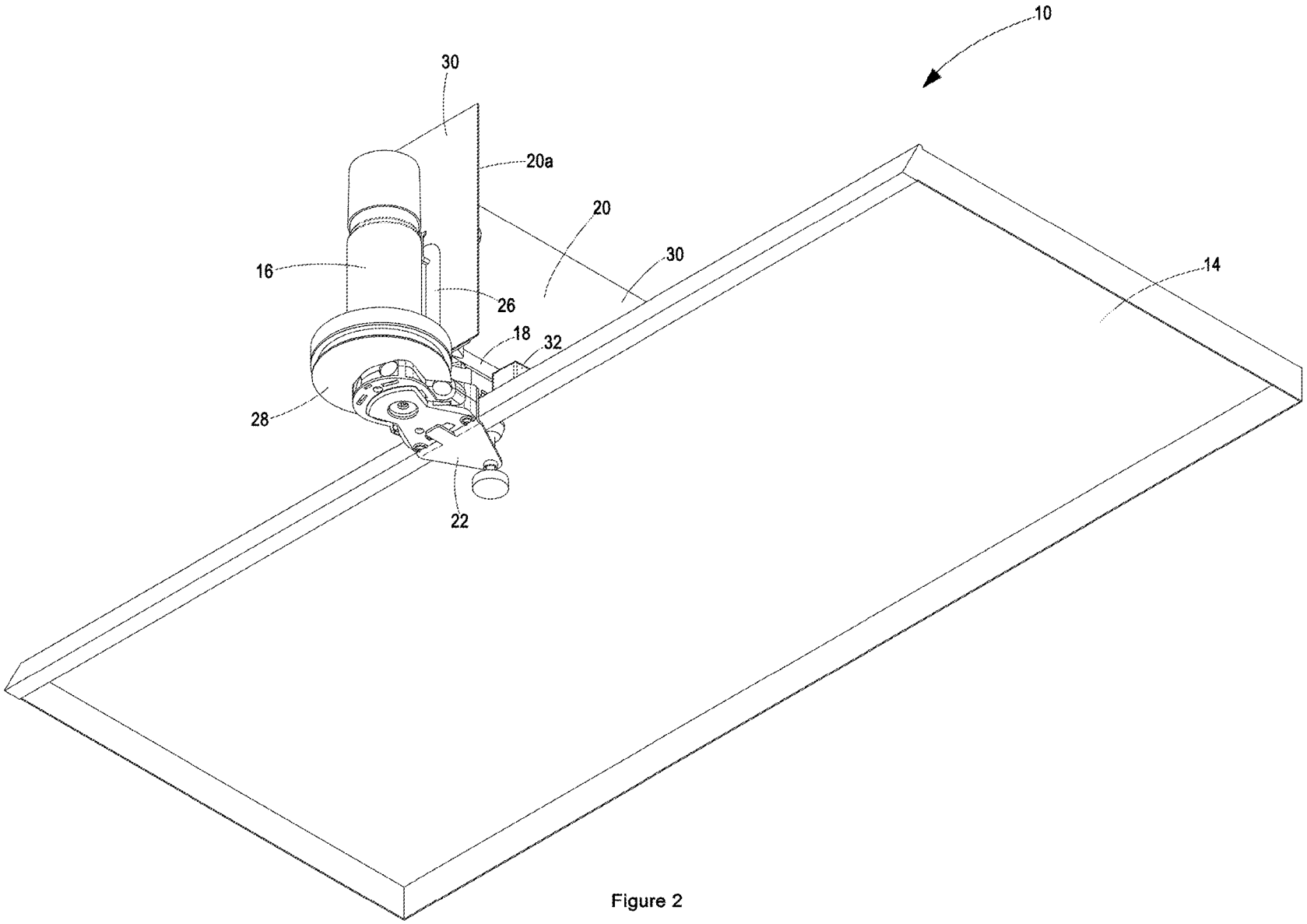
FIG. 2 is a lower perspective view of the product display apparatus in FIG. 1, with the arm in a retracted condition.
Figure 3:
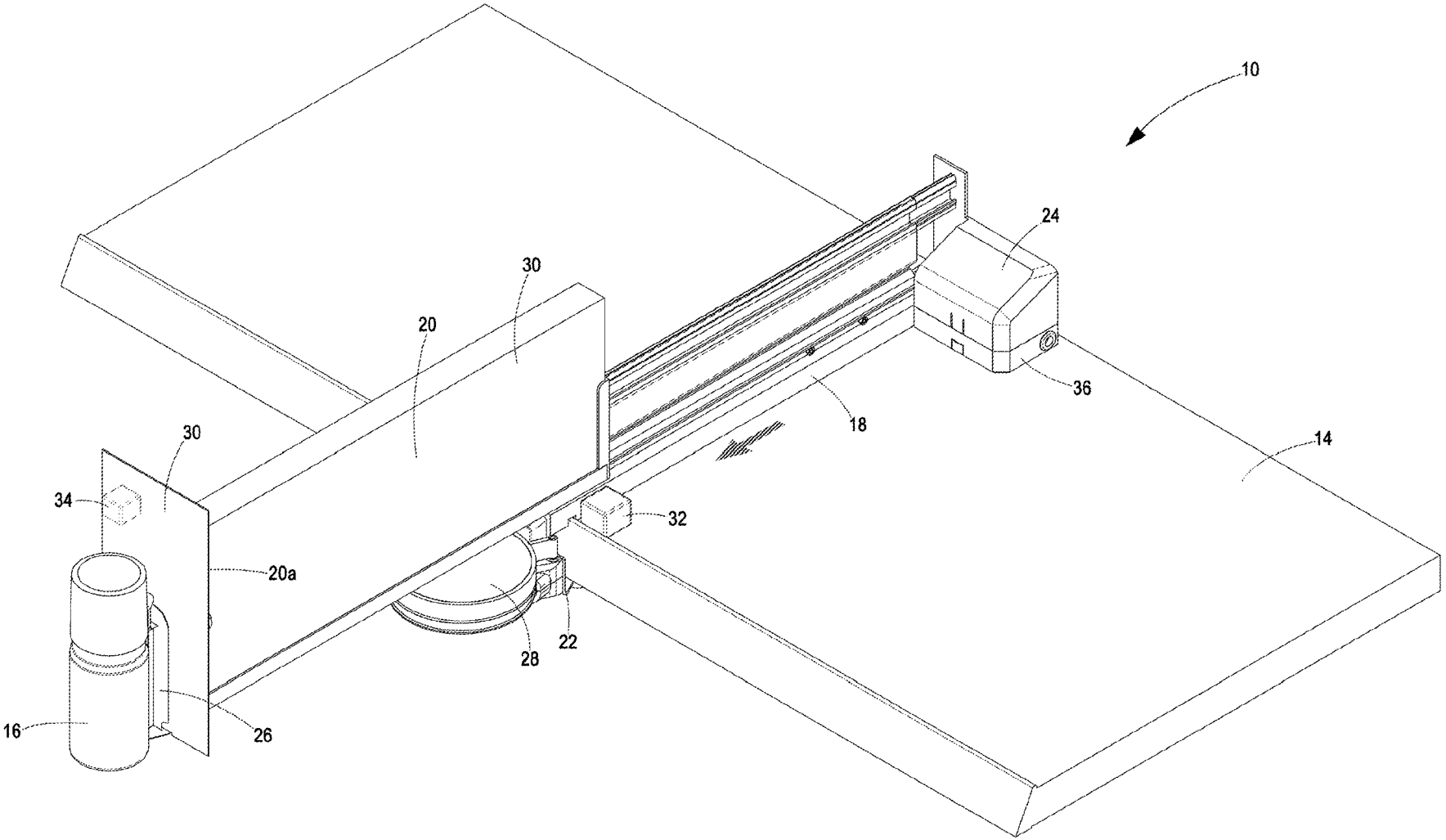
FIG. 3 is an upper perspective view of the product display apparatus in FIG. 1, with the arm in an extended condition.
Figure 4:
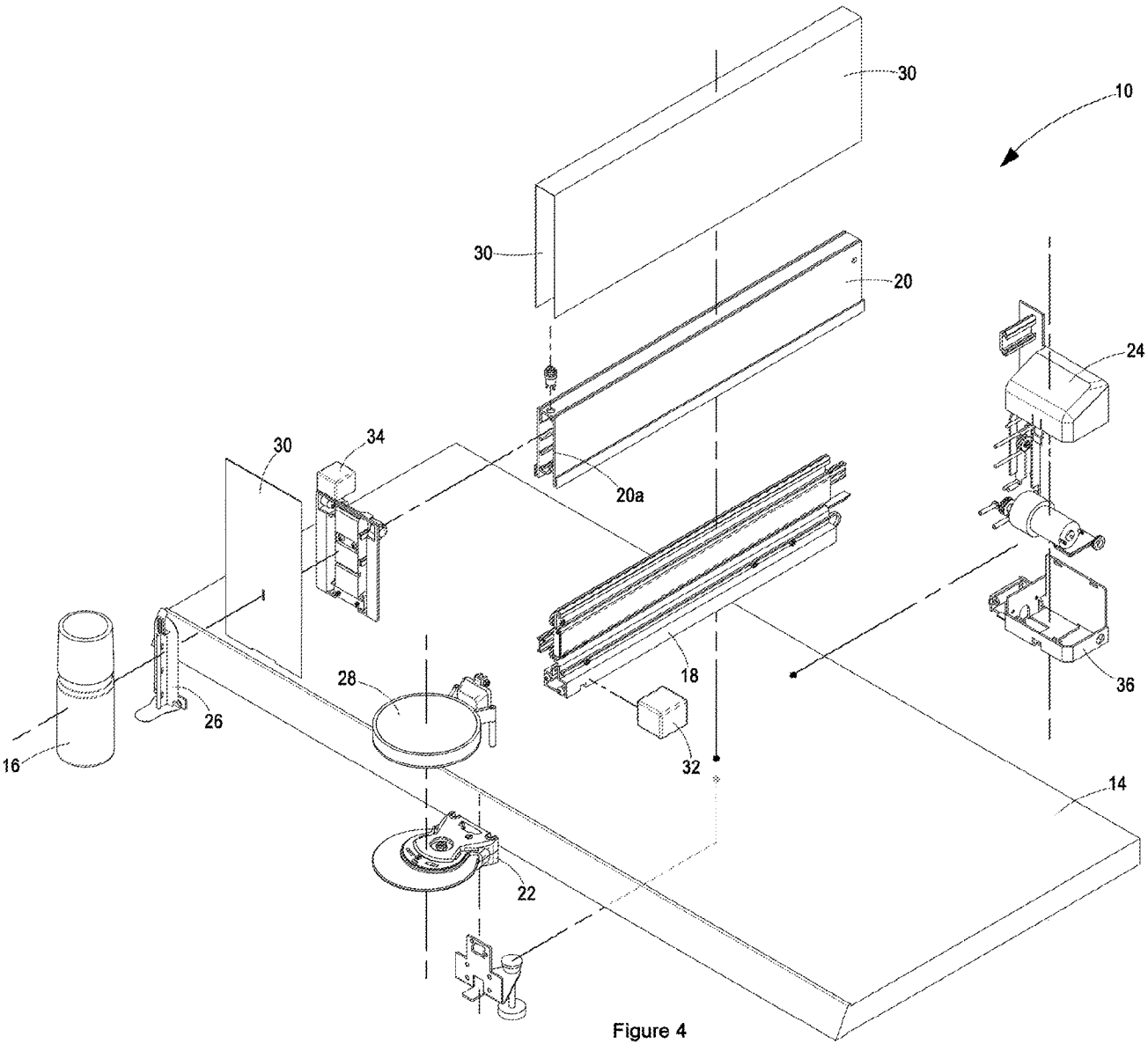
FIG. 4 is an exploded view of the product display apparatus in FIG. 1.

With reference to FIGS. 1 to 4 of the drawings, a product display apparatus 10 includes a shelving unit 12 defining a plurality of vertically arranged shelves 14, retail products 16 supported on the shelves 14, a base 18 and an extendable arm 20.

The shelving unit 12 is a standard shelving unit arranged along aisles in a retail store.

The base 18 is mounted to a shelf 14 of the shelving unit 12 via a clamp 22. Preferably, the clamp 22 mounts the base 18 to the operative front of a shelf 14 elevated between 1 m and 1.5 m above the ground on which the shelving unit 12 is supported.

The arm 20 is elongate, defining a first axial end 20*a*. The arm 20 is slidably mounted to the base 18 and movable between: a retracted condition shown in FIGS. 1 and 2 in which the arm 20 does not protrude more than 100 mm past the operative front edge of the shelf 14; and an extended condition, in which the first axial end 20*a* of the arm 20 extends between 200 mm and 600 mm past the operative front edge of the shelf 14.

An actuator 24 moves the arm 20 between the extended and retracted conditions. The actuator 24 could comprise a sprocket driven by an actuator motor, which sprocket engages a rack mounted on the arm 20.

A connecting means 26 is located at or near the first axial end 20*a* of the arm 20. The connecting means 26 facilitates securing of a product to the first axial end 20*a* of the arm 20. The Figures show a retail product 16 secured to the first axial end 20*a* of the arm 20 via the connecting means 26. However, it will be appreciated that brochures/pamphlets or a brochure/pamphlet holder could alternatively be secured to the first axial end 20*a* of the arm 20 via the connecting means 26. It is intended that the retail product 16 secured to the arm 20 is similar to retail products 16 supported on the shelf 14 adjacent the arm 20. Alternatively, it is intended that the brochures/pamphlets relate to retail products 16 supported on the shelf 14 adjacent the arm 20.

A platform 28 is mounted to the base 18, operatively below the retail product 16 secured to the first axial end 20*a* of the arm 20 when the arm 20 is in the retracted condition. The platform 28 is shown as a cylindrical disc, but it will be appreciated that the platform 28 could assume any other shape. Preferably, a first light (not shown) is associated with the platform 28 to illuminate the platform 28 and/or the retail product 16 secured to the arm 20 when the arm 20 is in the retracted condition.

The arm 20 could also include means (not shown) for securing an advertising board 30 to each side of the arm 20 and to the first axial end 20*a* of the arm 20. Such board securing means could be in the form of clips to facilitate substitution of advertising boards/panels 30 (including retail product 16 related advertising indicia) to the arm 20.

A second light (not shown) could be mounted on the arm 20 to illuminate the arm and/or the retail product 16 secured to the arm 20 and/or advertising boards 30 secured to the arm 20. The second light is preferably powered via an electrical conductor (not shown) that extends axially within the arm 20.

A first sensor 32, preferably comprising a set of three ultrasonic sensors 32 mounted on the base 18. The ultrasonic sensors 32 sense the presence of an object (e.g. a shopper) at: (i) a first predetermined distance, e.g. within a range of more than 2,500 mm from the ultrasonic sensor 32 (alternatively, the sensors 32 do not detect the presence of an object within a range of 2,500 mm; (ii) a second predetermined distance, e.g. within a range of 1,000 mm to 2,500 mm from the ultrasonic sensor 32; and (iii) a third predetermined distance, e.g. within a range of 0 mm to 1,000 mm from the ultrasonic sensor 32. A shield (not shown) disposed between the ultrasonic sensors 32 and the arm 20 shields/blocks movement of the arm 20 from the ultrasonic sensors 32.

At least one infrared sensor 34 is mounted at or near the first axial end 20*a* of the arm 20. The infrared sensor 34 senses movement of objects/shoppers in the vicinity of the infrared sensor 34 (e.g. within a range of 0 mm to 800 mm from the infrared sensor 34). The infrared sensor 34 is also powered via the electrical conductor that extends axially within the arm 20.

A control module 36 controls movement of the arm 20 relative to the base 18. More specifically, the control module 36 causes: (i) the actuator 24 to extend and retract the arm 20; and (ii) the first and second lights to switch on and off, in response to feedback from the ultrasonic sensors 32 and the infrared sensor 34. Preferably, the control module 36 induces:

- a first motion of the arm 20 (e.g. extension of the arm 20 to the extended condition) when the ultrasonic sensors 32 sense the presence of a shopper at a first predetermined distance (i.e. when there is no shopper in the greater vicinity of the arm 20)/when the ultrasonic sensors 32 do not sense the presence of a shopper);
- a second motion of the arm 20 (e.g. oscillation of the arm 20) when the ultrasonic sensors 32 sense the presence of a shopper at a second predetermined distance (i.e. within the medium vicinity of the arm 20);
- a third motion of the arm 20 (e.g. retraction of the arm 20 to the retracted condition) when the ultrasonic sensors 32 sense the presence of a shopper at a third predetermined distance (i.e. in close proximity to the arm 20); and
- rapid retraction of the arm 20 to the retracted condition when the infrared sensor 34 senses motion of an object/shopper.

Extension of the arm 20 attracts attention to retail products 16 from shoppers walking and looking along a shopping aisle, while retraction of the arm (consequent to feedback from sensors 32 and 34) reduces: the risk that the product display apparatus 10 causes an obstruction to shoppers; and the risk of contact between the product display apparatus 10 and shoppers, and the consequent risk of damage to the product display apparatus 10.

The invention claimed is:

1. A product display apparatus including:

a shelving unit defining a shelf;

a base mounted to the shelf;

an elongate arm slidably connected to the base;

an actuator for extending and retracting the arm;

at least one first sensor that senses the presence of an object at: (i) a first predetermined distance; and (ii) a second predetermined distance;

a control module that causes the actuator to extend and retract the arm in response to feedback from the at least one first sensor;

a connecting means at or near a first axial end of the arm; and a product secured to the first axial end of the arm via the connecting means.

2. A product display apparatus according to claim 1, wherein the first sensor is an ultrasonic sensor.

3. A product display apparatus according to claim 1, wherein the control module induces: (i) a first motion in the arm via the actuator when the at least one ultrasonic sensor senses the presence of an object at a first predetermined distance; and (ii) a second motion of the arm via the actuator when the at least one ultrasonic sensor senses the presence of an object at a second predetermined distance.

4. A product display apparatus according to claim 3, wherein the product is: a pamphlet or brochure relating to adjacent products supported on the shelf on which the base is mounted; a holder for such pamphlets/brochures; or a retail product similar to adjacent products supported on the shelf on which the base is mounted.

5. A product display apparatus according to claim 4, wherein the base is mounted to the shelf by a clamp or with adhesive.

6. A product display apparatus according to claim 5, wherein the arm is movable between: (i) an extended condition, in which the arm extends between 200 mm and 600 mm past the operative front edge of the shelf; and (ii)

a retracted condition, in which the arm does not protrude more than 100 m past the operative front edge of the shelf.

7. A product display apparatus according to claim 6, further including a platform mounted to the base, which platform is located operatively below the product secured to the first axial end of the arm when the arm is in the retracted condition.

8. A product display apparatus according to claim 7, wherein a first light is associated with the platform to illuminate the platform or the product secured to the first axial end of the arm.

9. A product display apparatus according to claim 8, further including means for securing an advertising board to each side of the arm and to the first axial end of the arm.

10. A product display apparatus according to claim 9, further including at least one infrared sensor, and wherein the control module causes the actuator to extend and retract the arm in response to feedback from the at least one ultrasonic sensor and the at least one infrared sensor.

11. A product display apparatus according to claim 10, wherein the at least one infrared sensor is located at the first axial end of the arm.

12. A product display apparatus according to claim 11, further including an electrical conductor that extends axially within the arm.

13. A product display apparatus according to claim 12, further including a second light on the arm.

14. A product display apparatus according to claim 13, wherein the at least one ultrasonic sensor is located on the base.

15. A product display apparatus according to claim 14, further including a shield between the at least one ultrasonic sensor and the arm, which shield blocks movement of the arm from the at least one ultrasonic sensor.

* * * * *